US011484178B2

(12) United States Patent
Kwon et al.

(10) Patent No.: US 11,484,178 B2
(45) Date of Patent: Nov. 1, 2022

(54) DISHWASHER

(71) Applicant: LG Electronics Inc., Seoul (KR)

(72) Inventors: Soonyong Kwon, Seoul (KR); Yongjin Choi, Seoul (KR); Kyuchang Jung, Seoul (KR); Shinwoo Han, Seoul (KR); Pilsu Kim, Seoul (KR); Sangsoo Ahn, Seoul (KR)

(73) Assignee: LG Electronics Inc., Seoul (KR)

( * ) Notice: Subject to any disclaimer, the term of this patent is extended or adjusted under 35 U.S.C. 154(b) by 167 days.

(21) Appl. No.: 16/857,870

(22) Filed: Apr. 24, 2020

(65) Prior Publication Data

US 2020/0337520 A1 Oct. 29, 2020

(30) Foreign Application Priority Data

Apr. 24, 2019 (KR) ..... 10-2019-0047615

(51) Int. Cl.

| | |
|---|---|
| ***A47L 15/10*** | (2006.01) |
| ***A47L 15/22*** | (2006.01) |
| ***A47L 15/23*** | (2006.01) |
| ***A47L 15/42*** | (2006.01) |

(52) U.S. Cl.

CPC ..... *A47L 15/4246* (2013.01); *A47L 15/10* (2013.01); *A47L 15/22* (2013.01); *A47L 15/23* (2013.01); *A47L 15/4209* (2016.11); *A47L 15/4214* (2013.01); *A47L 15/4278* (2013.01); *A47L 2601/03* (2013.01)

(58) Field of Classification Search

None

See application file for complete search history.

(56) References Cited

U.S. PATENT DOCUMENTS

2019/0200837 A1* 7/2019 Choi ..... A47L 15/0007

FOREIGN PATENT DOCUMENTS

| | | |
|---|---|---|
| EP | 3002358 | 4/2016 |
| GB | 2549705 | 11/2017 |
| JP | 2008119151 | 5/2008 |
| WO | WO2017190201 | 11/2017 |
| WO | WO2018026216 | 2/2018 |

OTHER PUBLICATIONS

Extended European Search Report in European Application No. 20171235.3, dated Jun. 9, 2020, 6 pages.

* cited by examiner

*Primary Examiner* — Levon J Shahinian

(74) *Attorney, Agent, or Firm* — Fish & Richardson P.C.

(57) ABSTRACT

A dishwasher includes a tub in which tableware is stored; a washing nozzle which is installed in the tub and sprays washing water; a washing pump which pumps the washing water to the washing nozzle; a sump in which the washing water is stored; and an air jet generator which is mounted in the tub, and supplies air to the washing water to contain an air bubble; wherein the air jet generator comprises: an air jet nozzle which sprays the washing water containing the air bubble into the tub; a discharge port which discharges the washing water containing the air bubble to the air jet nozzle; and a cap which surrounds at least a portion of the discharge port exposed in the tub.

20 Claims, 10 Drawing Sheets

DISHWASHER

CROSS-REFERENCE TO RELATED APPLICATION

This application claim the benefit of priority to Korean Application No. 10-2019-0047615, filed on Apr. 24, 2019, the disclosure of which is incorporated by reference in its entirety.

BACKGROUND

1. Technical Field

The present disclosure relates to a dishwasher, and more particularly, to a dishwasher having an air jet generator that generates air bubbles.

2. Description of the Related Art

A dishwasher can wash dishes by spraying washing water from a washing nozzle. In general, the dishwasher includes a tub forming a washing tank, a spray module for spraying washing water into the tub, and a sump mounted on the bottom surface of the tub to receive the washing water.

The spray module may include a washing pump. The washing pump can pump the washing water into the washing nozzle so that the washing water is sprayed from the washing nozzle at a high pressure. The washing water sprayed at a high pressure can wash the surface of the dishes, and remove dirt such as food waste from the dishes toward the bottom of the tub.

The washing water may include a chemical detergent, and the dishes may be washed based on a mechanical action of spraying the washing water at high pressure and a chemical action of the chemical detergent.

A filter may be disposed between the sump and the tub, and the filter filters foreign matter contained in the washing water and purifies contaminated washing water.

In some instances, the washing performance may be improved by including air bubbles in the washing water sprayed into the dishes.

Some microbubble generating apparatuses include a first suction path through which water is introduced, a second suction path through which air is introduced, a body provided with a bubble generating chamber connected to the first suction path and the second suction path, and a discharge path communicating with the bubble generating chamber. Such apparatuses may include a rotating body rotatably mounted in the first suction path and rotating when water is introduced from the first suction path, a suction fan disposed in the second suction path and rotating together when the rotating body rotates, and a bubble generating plate disposed in the bubble generating chamber and generating microbubbles by mixing water and air.

However, these microbubble generating apparatuses do not prevent dirt removed from the dishes from being inserted into a gap between the bubble generating apparatus and the tub, thereby contaminating the tub and washing water. Further, the vibration and noise are increased due to the bubble generating apparatus.

Some dishwashers include a tub in which a dish washing space is formed, a sump containing the washing water supplied into the tub, a spray module for spraying washing water toward the dishes, a pump that supplies the washing water stored in the sump to the spray module, an air jet generator that receives a portion of the washing water discharged from the pump and generates an air bubble in the washing water, and a discharge module for discharging the washing water discharged from the air jet generator to the bottom surface of the tub. However, these dishwashers also have the problem of contamination of the washing water due to the dirt inserted into a coupling portion between the air jet generator and the tub, as well as noise and vibration.

SUMMARY

Some implementations of the present disclosure provide a dishwasher that restricts dirt, such as food waste, from being inserted between a bubble generating apparatus and a tub, thereby maintaining cleanliness inside the dishwasher and restricting contamination of washing water.

Some implementations of the present disclosure provide a dishwasher capable of reducing noise and vibration generated in an air jet generator.

Some implementations of the present disclosure provide a dishwasher that restricts the washing water from leaking into a gap between the air jet generator and the tub.

In order to achieve the aforementioned and other advantages, particular embodiments of the present disclosure provide a dishwasher that includes an air jet generator mounted in the tub, and includes a cap covering at least a portion of the air jet generator exposed to the interior of the tub.

The air jet generator may include an air jet nozzle for spraying washing water that contains air bubbles. A discharge port of the dishwasher may be exposed to the inside of the tub, and a fastening member may be fastened to the discharge port so that the air jet generator is mounted in the tub and the cap may cover the discharge port and the fastening member.

The air jet generator may include an air tap casing that installs an air tap for crushing air bubbles. The air tap casing may be disposed between the air jet nozzle and the discharge port. The cap may be formed in the air tap casing.

The cap may be formed in the air jet nozzle disposed downstream of the air tap.

The cap may extend from the outer surface of the air tap casing or air jet nozzle and extend downward.

A seal may be disposed between the cap and the bottom surface of the tub.

A seal may be disposed between the inner surface of the cap and the air tab casing.

Particular embodiments of the present disclosure described herein provide a dishwasher that includes a tub, a washing nozzle, a washing pump, a sump, and an air jet generator. The washing nozzle may be disposed in the tub and configured to spray washing water. The washing pump may be configured to pump the washing water to the washing nozzle. The sump may be configured to receive the washing water. The air jet generator may be mounted in the tub and configured to supply air to the washing water to generate an air bubble. The air jet generator may include an air jet nozzle, a discharge port, and a cap. The air jet nozzle may be configured to spray the washing water that contains the air bubble into the tub. The discharge port may be configured to discharge the washing water that contains the air bubble to the air jet nozzle. The cap may surround at least a portion of the discharge port that is exposed in the tub.

In some implementations, the dishwasher can optionally include one or more of the following features. The dishwasher may include a fastener that is coupled to the discharge port and fixes the air jet generator to the tub. The cap may surround the fastener. The discharge port may include a first thread on an outer circumferential surface of the discharge port. The fastener may include a second thread on an inner circumferential surface of the fastener. The second thread may engage with the first thread of the discharge port. The dishwasher may include a seal disposed between the cap and the fastener. The cap may include a groove at an inner circumferential surface of the cap that faces the fastener. At least a portion of the seal may be inserted into the groove. The cap may include first and second protrusions extending toward the fastener and at least partially defining the groove. At least one of the first or second protrusions may extend from an end of the cap that interfaces with the tub. The cap may be disposed at least partially in the air jet nozzle. The cap may be disposed relative to the air jet nozzle to define a discharge hole of the air jet nozzle. The cap may extend in a direction away from the air jet nozzle. The air jet generator may include an air tap and an air tap casing. The air tap may be disposed in the air jet nozzle and configured to break the air bubble contained in the washing water. The air tap casing may be disposed between the air jet nozzle and the discharge port and have inner and outer surfaces. The air tap casing may support the air tap at the inner surface of the air tap casing. The cap may be disposed on the outer surface of the air tap casing. The tub may include a mounting hole defined at a surface of the tub and configured to at least partially receive the air jet generator. The tub may further include a seat portion around the mounting hole and extending from the surface of the tub toward an interior of the tub. The cap may surround at least a portion of the seat portion. The cap may include a first portion extending radially and a second portion extending from a circumferential end of the first portion in a direction away from the air jet nozzle. The dishwasher may include a seal disposed at an interface between the cap and the tub. The cap may include a groove at an end of the cap that faces the tub. The seal may be at least partially inserted into the groove. The cap may include a body extending in a direction away from the air jet nozzle. The cap may have at least one bent portion. The cap may include a first portion that is spaced from the fastener and extended in a radial direction relative to the discharge port. The cap may include a second portion that is radially spaced apart from an outer circumferential surface of the fastener. The second portion may include a third portion that is rounded at the circumferential end of the first portion. The air jet nozzle may include a discharge hole. The cap may be disposed between the discharge hole of the air jet nozzle and the discharge port. The tub may include a seat portion at least partially extending from a surface of the tub toward an interior of the tub. The cap may be disposed on the seat portion.

BRIEF DESCRIPTION OF THE DRAWINGS

The above and other objects, features and advantages of the present disclosure will be more apparent from the following detailed description in conjunction with the accompanying drawings, in which.

DETAILED DESCRIPTION

Figure 1:
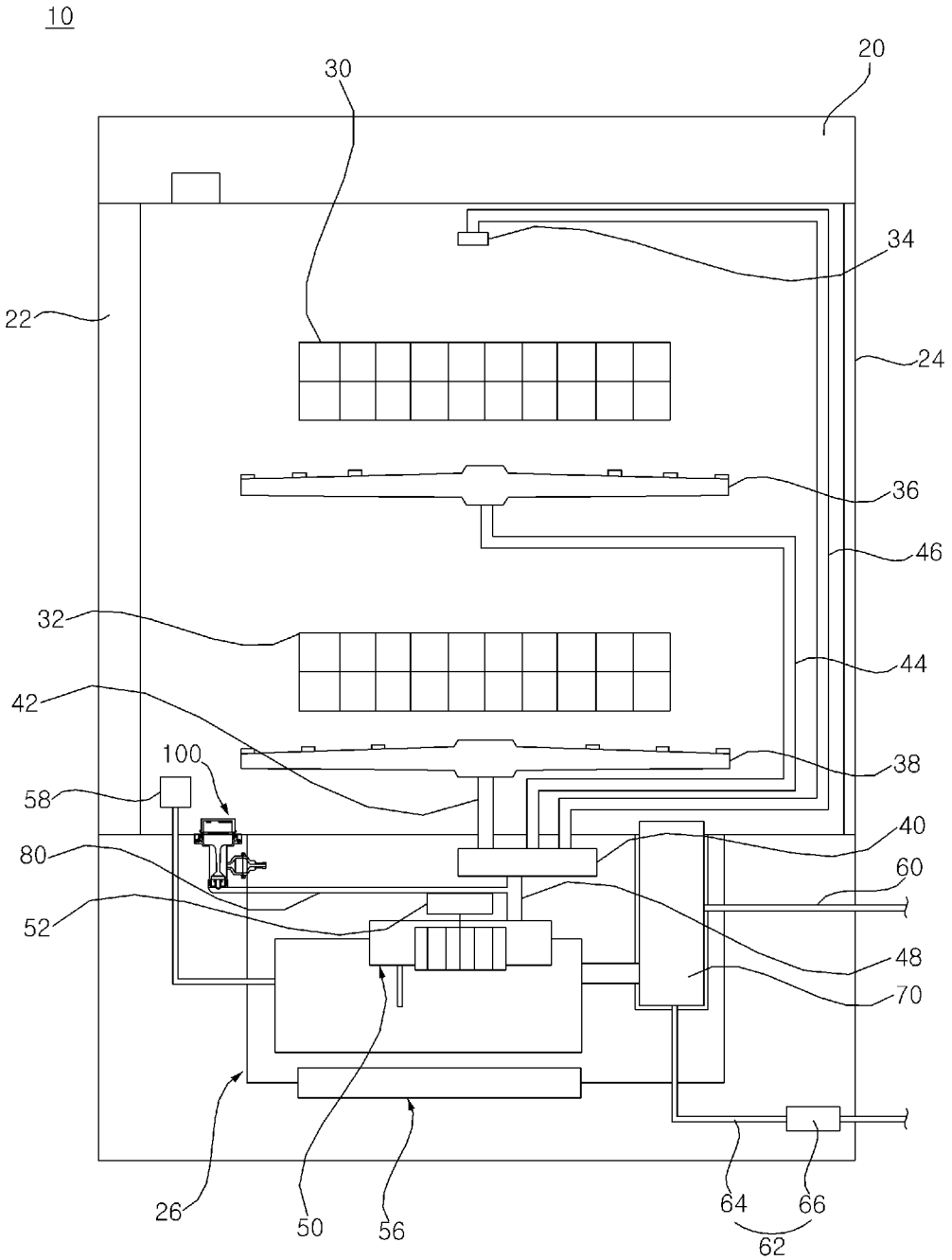
FIG. 1 is a schematic interior view of an example dishwasher including an air jet generator.

Advantages and features of the present disclosure will be made clear from the embodiments described below in detail with reference to the accompanying drawings. The present disclosure may, however, be embodied in many different forms and should not be construed as being limited to the embodiments set forth herein. Rather, these embodiments are provided so that this disclosure will be thorough and complete, and will fully convey the scope of the invention to those skilled in the art. Like reference numerals refer to like elements throughout the specification.

Figure 2:
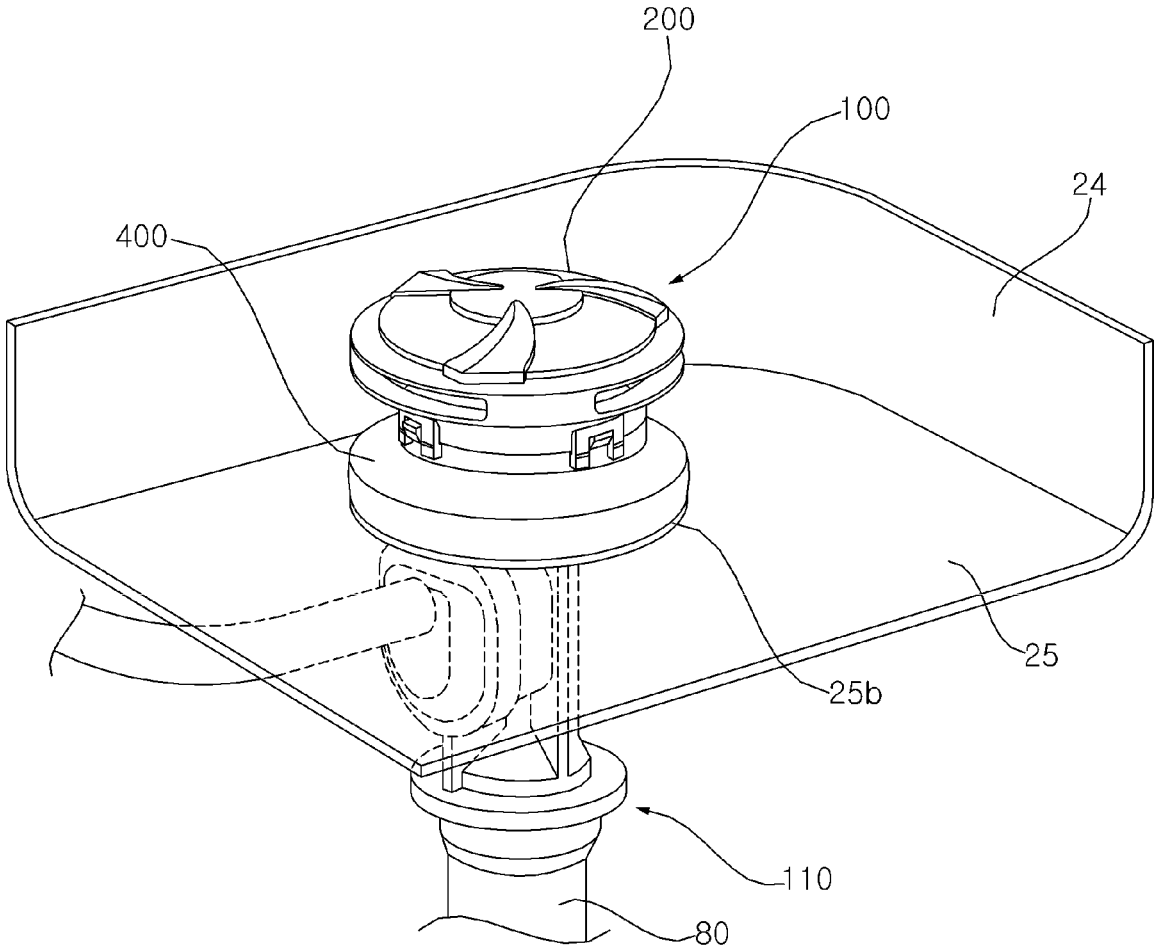
FIG. 2 is a perspective view of an example air jet generator that is installed inside the dishwasher.

An example dishwasher will be described with reference to FIGS. 1 and 2.

The dishwasher 10 includes a cabinet 20 forming an external shape, a door 22 coupled to the cabinet 20 to open and close the interior of the cabinet 20, and a tub 24 installed inside the cabinet 20. The dishwasher 10 may include a dispenser that temporarily stores loaded detergent, and supplies the detergent into the tub 24 in a washing step.

The tub 24 provide a space in which dishes are placed and washed. One or more racks 30, 32 for receiving the dishes, and a spray module for spraying washing water toward the dishes received in the racks 30, 32, are provided inside the tub 24. A sump 26 for storing the washing water and a washing pump 50 for pumping the washing water stored in the sump to the spray module are disposed in the lower side of the tub 24. An air jet generator 100 for generating air bubbles in the washing water that is sprayed into the tub is mounted in the bottom surface 25 of the tub.

The spray module includes one or more washing nozzles 34, 36, 38 for spraying washing water toward the dishes, and one or more supply pipes 42, 44, 46 connecting the washing pump 50 and the washing nozzles 34, 36, 38.

The washing nozzles 34, 36, 38 may include a lower nozzle 38 for washing the dishes stored in a lower rack 32, an upper nozzle 36 for washing the dishes stored in an upper rack 30, and a top nozzle 34 located in the uppermost portion of the tub 24 and spraying the washing water. The upper nozzle 36 may be located in a lower side of the upper rack 30. The top nozzle 34 may be disposed in a higher position than the upper rack 30, and spray washing water to the upper rack 30 and the lower rack 32. When the washing pump 50 operates to pump the washing water stored in the sump 26, the washing water is supplied to the washing nozzles 34, 36, 38.

The dishwasher may include a flow path switching unit 40 for selecting at least one of a first supply pipe 42, a second supply pipe 44, and a third supply pipe 46, and supplying washing water stored in the sump through the selected pipe(s).

The sump 26 is a storage tank for collecting the washing water supplied from the outside, and the washing water collected in the sump may be sprayed from the washing nozzles 34, 36, 38 or an air jet nozzle 200 of the air jet generator 100 by operating the washing pump 50.

The outlet of the washing pump 50 may be connected to a pump pipe 48, and the pump pipe 48 may be connected to the flow path switching unit 40. A BLDC motor (Brushless Direct Current motor) may be used for a washing motor 52 that drives the washing pump 50. A branch pipe 80 is branched from the pump pipe 48 and connected to the air jet generator 100.

The dishwasher 10 may further include a water supply module 60 for supplying water to the sump 26, a drainage module 62 connected to the sump 26 to discharge washing water to the outside, a filter module 70 for filtering the washing water, and a heating module 56 for heating the washing water. The drainage module 62 may include a drainage flow path 64 and a drainage pump 66.

The heating module 56 is configured to supply high-temperature steam to the tub. A steam nozzle 58 is connected to the sump 26 and configured to eject a steam generated by the heating module 56 into the tub 24 through a steam flow path. A valve may be installed in the steam flow path to control the flow of the steam.

Figure 3:
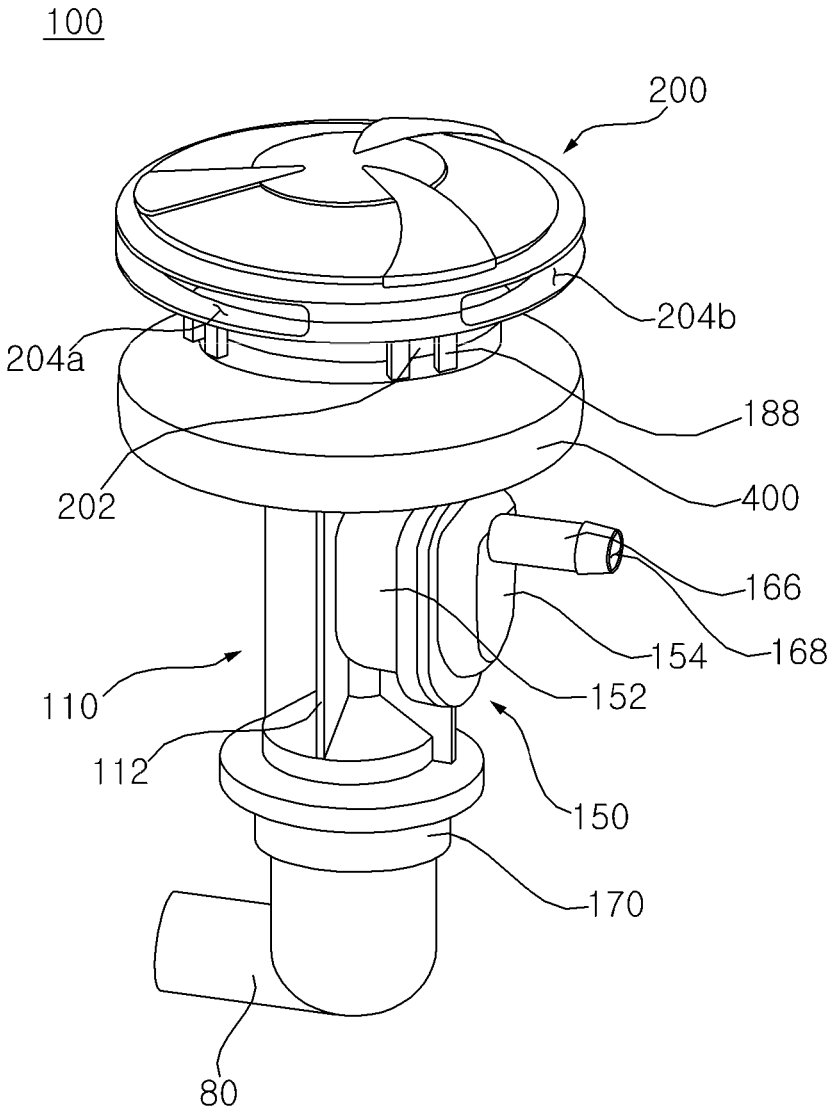
FIG. 3 is a perspective view of the air jet generator.

An example of the air jet generator 100 will be described in more detail with reference to FIGS. 3 to 5.

In some implementations, the air jet generator 100 includes an air crushing pipe 110 that can be disposed in the upper side of the branch pipe 80 and mix air with the washing water introduced through the branch pipe 80. The air jet generator 100 can include an air tap 180 that can be disposed in the upper side of the air crushing pipe 110 and configured to promote the generation of air bubbles. An air jet nozzle 200 can be disposed in the upper side of the air tap 180 and configured to spray into the tab the washing water that contains the air bubbles supplied from the air tap 180. An impeller 170 can be disposed between the branch pipe 80 and the air crushing pipe 110.

The impeller 170 includes a cylindrical impeller casing 172 that can be installed on the inner surface of an impeller mounting portion 82 at a distal end of the branch pipe 80. The impeller 170 can include a vane 174 disposed inside the impeller casing 172. As the washing water passes through the vane 174, swirling flow is generated by centrifugal force and introduced into the air crushing pipe 110.

The air introduced from the outside is crushed by the air crushing pipe 110 and then mixed with the washing water that passed through the impeller 170.

The air crushing pipe 110 has a decompression portion 120, an air inflow hole 146, a pressurizing portion 130, and a discharge port 140. The decompression portion 120 is configured to decompress the washing water along the flow direction of the washing water. The air inflow hole 146 is configured to introduce external air into the air crushing pipe due to a negative pressure generated in the pipe at a downstream portion of the decompression portion. The pressurizing portion 130 is configured to pressurize the washing water containing air. The discharge port 140 is provided adjacent to the pressurizing portion 1340 and configured to discharge the washing water that has passed through the pressurizing portion 130.

The washing water that flows through the air crushing pipe 110 passes through the decompression portion 120 so that the pressure of the washing water is lowered. Since the washing water that passed through the decompression portion 120 is negatively pressurized due to the decompression, external air may be suctioned into the air crushing pipe 110 through the air inflow hole 146. In addition, the air that is introduced into the air crushing pipe 110 through the air inflow hole 146 is primarily crushed by a rotating flow that flows at a high speed along the decompression portion 120.

In some implementations, a flow path diameter D1 at the inlet of the decompression portion 120 may be smaller than a flow path diameter D2 at the outlet of the pressurizing portion 130.

The decompression portion 120 may include a first decompression portion 122 for rapidly decompressing the washing water introduced into the air crushing pipe 110 first, and a second decompression portion 124 disposed downstream of the first decompression portion 122 to increase or maintain the flow rate of the washing water introduced through the first decompression portion 122. The washing water flowing through the decompression portion 120 may pass through the first decompression portion 122 and the second decompression portion 124, and the pressure may be lowered to form a negative pressure.

The air inflow hole 146 may be formed between the decompression portion 120 and the pressurizing portion 130. The air inflow hole 146 may fluidly communicate the inside of the air crushing pipe 110 with the inside of an air chamber 150 described later, and an outside air may be introduced into the air crushing pipe 110 through the air inflow hole 146. Here, the outside refers to the outside of the air crushing pipe, and may refer to the outside of the cabinet 20 or the inside of the tub 24.

In some implementations, the pressurizing portion 130 has a wide cross-sectional area of the flow path in the flow direction of the washing water. The pressurizing portion 130 can pressurize the washing water to crush the air in the washing water additionally (e.g., for a second time).

The pressurizing portion 130 may have a length longer than the decompression portion 120. The pressurizing portion 130 may include a first pressurizing portion 132 for firstly pressurizing the flowing washing water introduced from the decompression portion, and a second pressurizing portion 134 for additionally pressurizing the washing water passing through the first pressurizing portion 132. The first pressurizing portion 132 gradually pressurizes the washing water in comparison with the second pressurizing portion 134. The first pressurizing portion 132 has a smaller rate of change in the flow path cross-sectional area than the second pressurizing portion 134. The flow path length of the first pressurizing portion 132 is formed to be longer than the flow path length of the second pressurizing portion 134, but the difference in the inner diameters of both ends of the first pressurizing portion 132 may be smaller than the difference in the inner diameters of the both ends of the second pressurizing portion 134.

The air that is introduced into the air inflow hole 146 can be crushed in the first pressurizing portion 132 by the flow rate and centrifugal force of the flowing washing water. Due to rapid expansion of the flow path section, the washing water may be depressurized in the second pressurizing portion 134, to effectively crush the air existing in the washing water.

An expansion pipe portion 136 can be provided to maintain an extended flow path section through the second pressurizing portion 134. A discharge port 140 can be provided at a distal end of the expansion pipe portion 136. The expansion pipe portion 136 is extended to an inner circumferential surface 185 of an air tap casing 184 described below. The expansion pipe portion 136 and the inner circumferential surface 185 of the air tap casing 184 may be configured to adjust the distance between the air tap 180 and the air inflow hole 146. In order to effectively crush the air in the air tap 180 described later, the distance H1 between the air tap 180 and the air inflow hole 146 can be equal to or larger than the diameter D2 of the air tap 180. The total of the flow path lengths defined by the inner circumferential surface 185 of the air tap casing 184, the first pressurizing portion 132, the second pressurizing portion 134, and the expansion pipe portion 136 can be equal to or similar to the distance H1, and thus be equal to or larger than the diameter D2 of the air tap 180.

An air chamber 150 for reducing noise generated in the air crushing pipe 110 can be disposed at a side of the air crushing pipe 110 exterior of the air crushing pipe 110 in which the air inflow hole 146 is defined. The air inflow hole 146 can be formed in one side of the lower end of the air chamber 150.

The air chamber 150 can include an external air inflow hole 168 through which external air flows into the air chamber 150. The external air inflow hole 168 can be defined at the upper end of the air chamber 150.

The air chamber 150 defines a space therein, and includes a chamber body 152 having an open side and a chamber cover 154 configured to cover the open side of the chamber body 152.

The chamber cover 154 may include the external air inflow hole 168 through which external air is introduced. The chamber cover 154 can include an external connection pipe 166 that extends outward from a portion that defines the external air inflow hole 168. A separate connection hose may be mounted to the external connection pipe 166 to connect to the outside of the cabinet 20.

The air chamber 150 may include a first pipe 158 extended along an inner lower surface 155 of the air chamber 150 from the air inflow hole 146, and may include a second pipe 160 formed along an inner upper surface 156 of the air chamber 150 from the external air inflow hole 168. The first and second pipes 158 and 160 may reduce noise by expanding or reducing a path through which noise is propagated in the air chamber 150. The second pipe 160 may be formed by a second pipe member 162 extending to the inside of the air chamber 150 and the upper surface of the chamber body 152 at the periphery of the external air inflow hole 168 of the chamber cover 154.

The air crushing pipe 110 may include a reinforcing protrusion 112. The reinforcing protrusion 112 may protrude from the outer circumference of the air crushing pipe 110 in the longitudinal direction in which the decompression portion 120 and the pressurizing portion 130 defines a flow path. In some implementations, four reinforcing protrusions 112 may be arranged at 90° angle relative to one another on the outer circumferential surface of the air crushing pipe 110.

A cylindrical discharge port 140 can be disposed at the upper side portion of the air crushing pipe 110 and configured to discharge the washing water that passed through the pressurizing portion 130. The discharge port 140 can include a ring-shaped flange 138 at the lower side of the discharge port 140.

Figure 4:
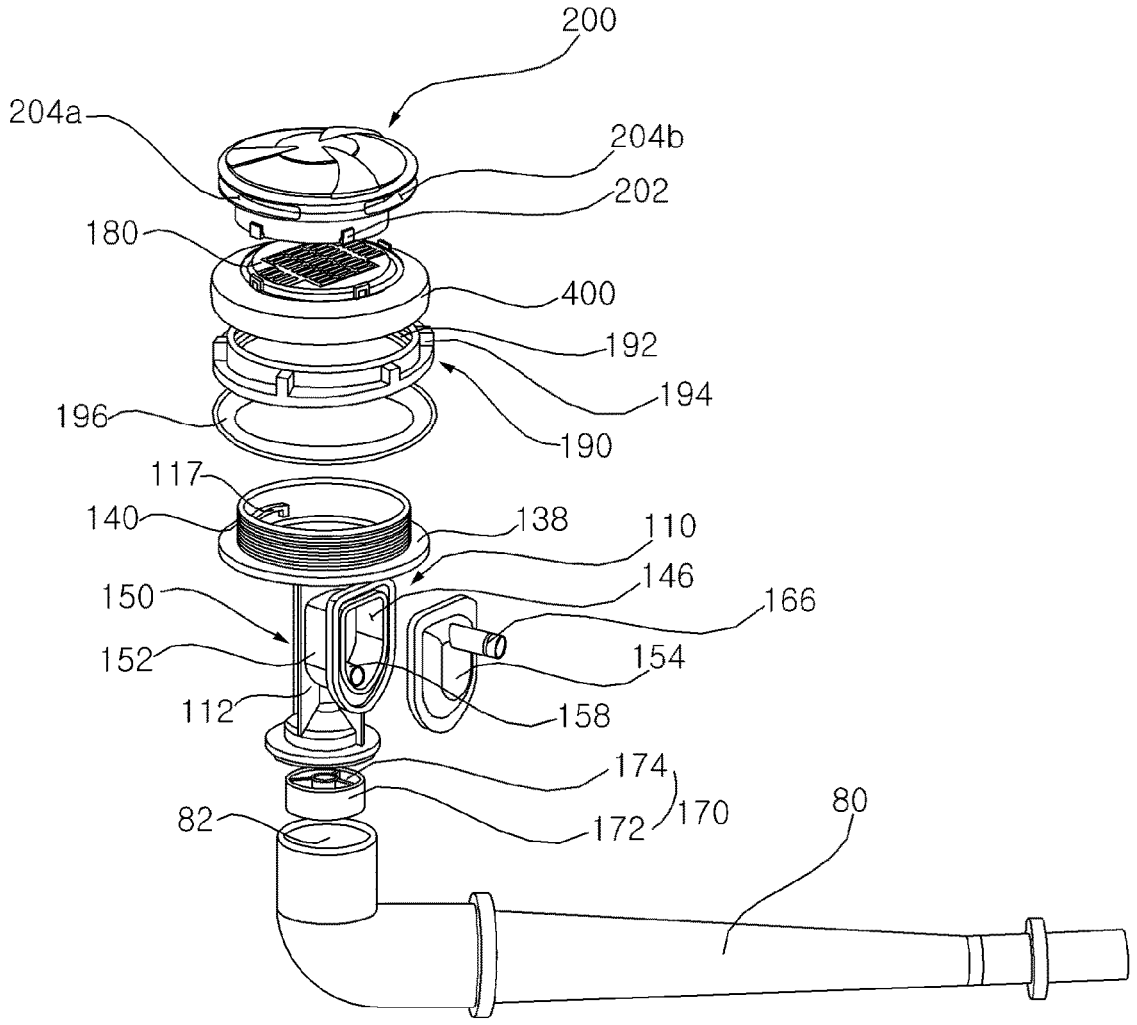
FIG. 4 is an exploded perspective view of the air jet generator.
Figure 5:
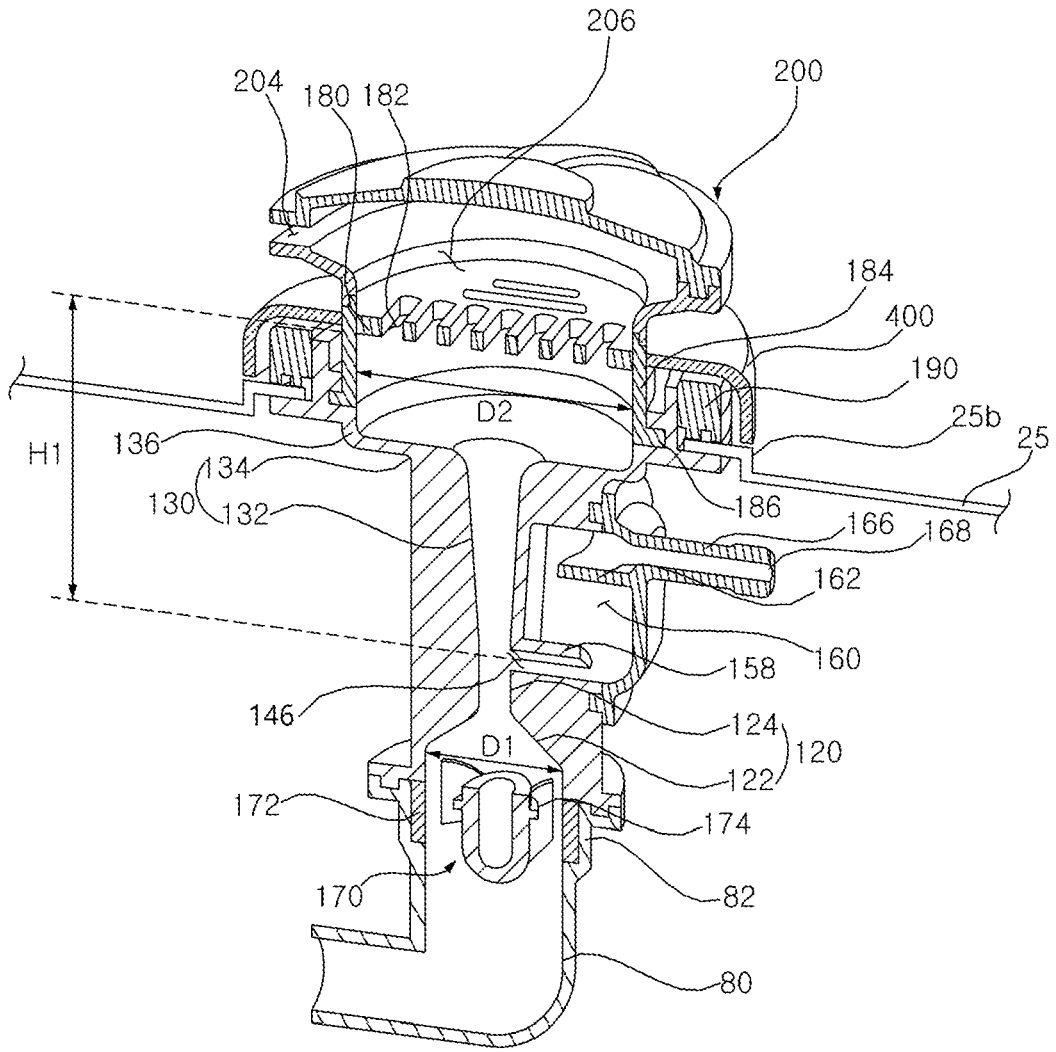
FIG. 5 is a cross-sectional view of the air jet generator.

Referring to FIGS. 4 to 5, the air tap 180 is installed in the cylindrical air tap casing 184 and is disposed downstream of the discharge port 140.

In some implementations, the air tap 180 has a disc shape, and includes a plurality of holes 182 so that the air in the washing water is crushed additionally (e.g., for a third time) while passing through the plurality of holes 182 formed in the air tap 180.

The air tap casing 184 may be integrally formed with the air tap 180. Alternatively, the air tap casing 184 may be formed separately from the air tap 180 and connected to the air tap 180. The inner circumferential surface 185 of the air tap casing 184 forms a flow path for the washing water that passed through the air crushing pipe 110. The inner circumferential surface 185 of the air tap casing 184 may be formed to have the same diameter as the expansion pipe portion 136 of the air crushing pipe 110.

The air tap casing 184 may include a discharge port coupling protrusion 186, which is formed in the outer circumference, for coupling with the discharge port 140 of the air crushing pipe 110. The discharge port coupling protrusion 186 of the air tap casing 184 is inserted into a discharge port coupling groove 117 formed in the inner circumferential surface of the discharge port 140 so that the air tap casing 184 is fastened to the air crushing pipe 110.

In some implementations, the air tap casing 184 is detached to the upper side of the air crushing pipe 110. When dirt accumulates on the air tap and the air tap is blocked, the air tap casing 184 may be separated from the air crushing pipe 110 to remove the dirt.

An example of the air jet nozzle 200 coupled to the air tap casing 184 will be described with reference to FIGS. 4 to 7.

The air jet nozzle 200 includes an inflow hole 206 which has a hollow cylindrical shape and has a lower portion through which washing water is introduced. The air jet nozzle 200 includes a plurality of discharge holes 204, which is formed in a side circumferential surface, through which the washing water is sprayed into the tub 24.

The air jet nozzle 200 includes an upper nozzle portion 207 and a lower nozzle portion 208. The upper and lower nozzle portions 207, 208 are configured to define a plurality of discharge holes 204 on the circumferential surface between the upper and lower nozzle portions 207, 208. A plurality of fastening hooks 202 are provided at the lower nozzle portion 208 along the lower circumferential surface and spaced apart from one another at certain distances. The air tap casing 184 can include a plurality of hook hangers 188 which can be coupled to the hooks 202. For example, the hook 202 can be fastened to the hook hanger 188.

Referring to FIG. 5, an example of the mounting structure of the air jet generator and the tub will be described.

The tub can include a mounting hole 25*a* at the bottom surface 25, and a seat portion 25*b* that protrudes upward from a portion of the bottom surface 25 around the mounting hole 25*a*.

The discharge port 140 of the air crushing pipe 110 extends through the mounting hole 25*a* and protrudes upwards from the seat portion 25*b*. A male screw formed in the outer circumferential surface of the discharge port 140 can be exposed to the outside.

A fastening member 190 is disposed to the outside of the outer circumferential surface of the discharge port 140. The fastening member 190 includes a female screw formed in the inner circumferential surface of the fastening member 190. The female screw of the fastening member 190 can be coupled with the male screw of the discharge port 140. By rotating the fastening the member 190, the air crushing pipe 110 can be mounted at the bottom surface 25 of the tub.

The discharge portion 140 can include a flange 138 that extends in the radial direction at the lower side of the outer circumferential surface of the discharge port 140. The upper surface of the flange 138 can be in close contact with the lower surface of the seat portion 25*b*. The lower surface of the fastening member 190 can be in close contact with the upper surface of the seat portion 25*b* so that the air crushing pipe 110 is in close contact with the bottom surface 25 of the tub.

In some implementations, a sealer 196 can be inserted into the lower surface of the fastening member 190, so that the fastening member 190 and the bottom surface 25 of tub may be more closely coupled.

A cap according to an embodiment of the present disclosure will be described based on FIG. 5 and with reference to FIGS. 6 and 7.

Figure 6:
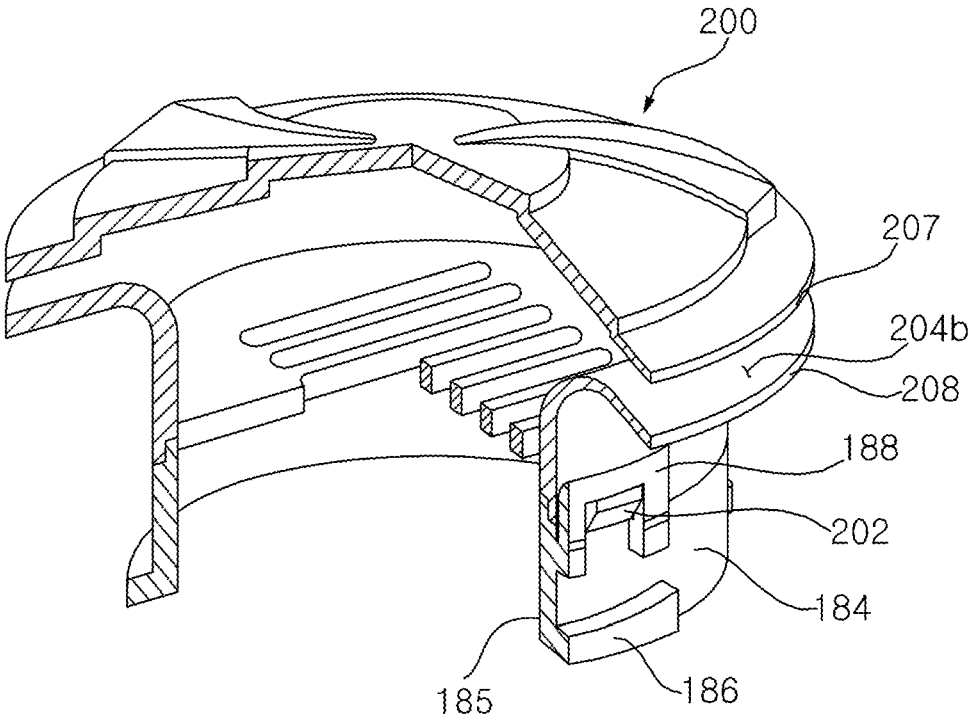
FIG. 6 is a partial perspective view of the air jet generator.
Figure 7:
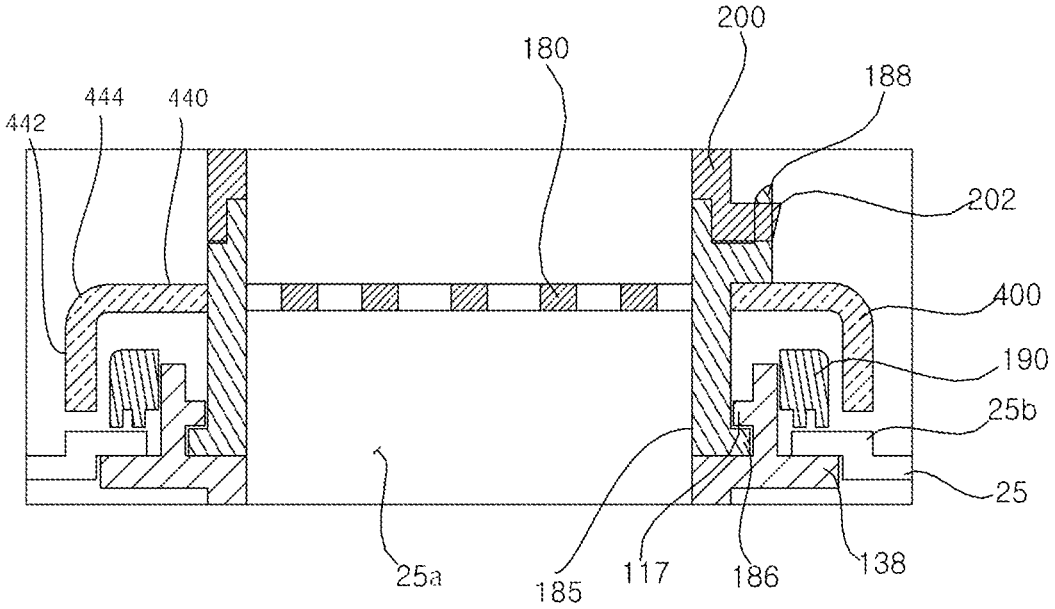
FIG. 7 is an enlarged sectional view of FIG. 6.

FIG. 6 shows the air jet generator 100 with the cap 400 removed to show the discharge port coupling protrusion 186. In some cases, the cap 400 can be disposed in the air jet generator 100 in the same manner as in FIGS. 5 and 7. For example, in FIG. 6, the cap can be disposed in the air jet generator 100 such that the cap extends in the radial direction from the bottom of the hook hanger 188 and cover the coupling protrusion 186.

The air jet generator 100 can include a cap 400 that is implemented to restrict dirt, such as food waste, from being trapped in a portion of the air jet generator 100 that is exposed into the tub. The cap 400 is configured to cover the discharge port 140. When the discharge port 140 of the air jet generator 100 is mounted in the tub by the fastening member 190, the cap 400 may cover the discharge port 140 and the fastening member 190 together.

The cap 400 is disposed between the air jet nozzle 200 and the discharge port 140. The cap 400 may be disposed below the discharge hole 204 of the air jet nozzle and may be disposed above the discharge port 140. The cap 400 may be disposed in the air tap casing 184 disposed between the air jet nozzle 200 and the discharge port 140.

A thread can be formed in the outer circumferential surface of the discharge port 140, and another thread can be formed in the inner circumferential surface of the fastening member 190. The thread of the discharge port 140 and the thread of the fastening member 190 are configured to engage with to each other. The cap may cover the thread of the discharge port 140 and the thread of the fastening member 190 together. The cap 400 may be formed to extend from the air tap casing 184. For example, the cap 400 may be configured to protrude in the circumferential direction from the air tap 180 or the outer circumferential surface of the air tap casing 184. In some implementations, the cap 400 may be formed to protrude from the bottom end of the hook hanger 188 of the air tap casing.

The cap 400 can extend radially from the outer circumferential surface of the air tap casing 184, and further extend downward. The cap 400 may include a horizontal protrusion 440 that horizontally protrudes in the radial direction and a downward extension portion 442 extended downward from the horizontal protrusion. In some implementations, the downward extension portion 442 may extend from the edge of the horizontal protrusion 440. In some implementations, a bent portion 444 may be formed at a portion in which the downward extension portion 442 starts extending from the horizontal protrusion 440.

In some implementations, the horizontal protrusion can be spaced apart from the fastening member in the upper portion of the fastening member.

The downward extension portion 442 can extend downward from the end of the horizontal protrusion 440. The downward extension portion can be disposed to be spaced apart from the outer circumferential surface of the fastening member from the outside of the fastening member.

In some implementations, at least one of the horizontal protrusion 440 or the downward extension portion 442 may be rounded at a portion where the horizontal protrusion 440 and the downward extension portion 442 are connected. For example, the downward extension portion 442 may be rounded at the edge of the horizontal protrusion 440 to which the downward extension portion 442 is connected.

The cap 400 may be disposed in the upper portion of the seat portion 25*b*.

Figure 10:
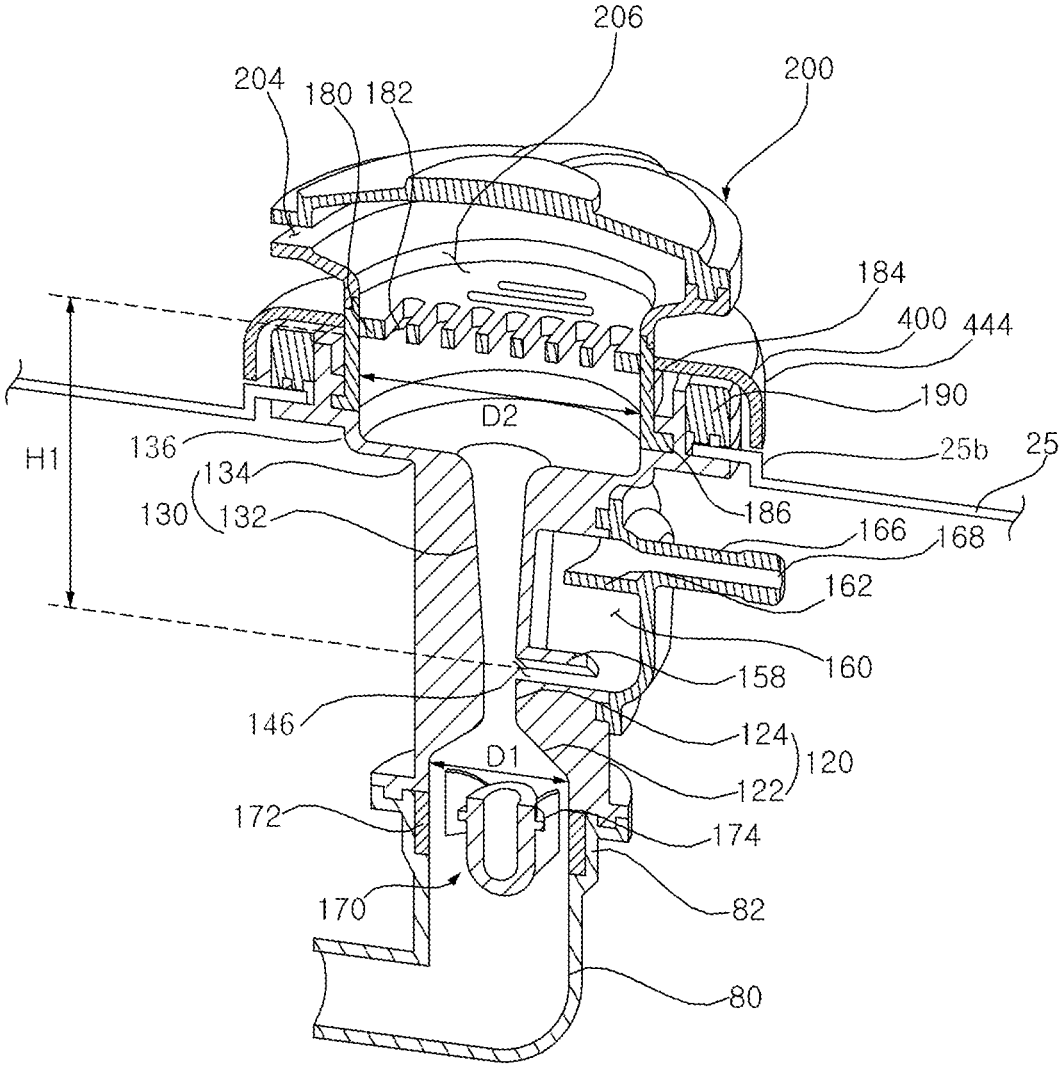
FIG. 10 is a cross-sectional view of yet another air jet generator.

In embodiments where the mounting hole 25*a* and the seat portion 25*b* are defined at the bottom surface 25 of the tub and the air jet generator penetrates the mounting hole 25*a* and is coupled to the seat portion 25*b*, the cap 400 may cover the outer surface of the seat portion 25*b* together with a coupling portion 300 (see FIG. 10). The cap 400 that also covers the seat portion 25*b* can more effectively restrict the inflow of dirt and the leakage of washing water.

The cap 400 can include a first seal 420 at the bottom surface of the cap 400 to restrict the inflow of dirt. The first seal can be disposed between the bottom surface 25 of the tub and the lower surface of the cap 400 or between the seat portion 25*b* and the lower surface of the cap 400. For example, the first seal 420 can be disposed between the lower surface of the cap 400 and the bottom surface 25 of the tub.

The cap 400 can include a groove 422 at the lower surface of the cap 400. At least a portion of the first seal 420 may be inserted into the groove 422. The groove 422 can be defined on the lower end of the cap 400 that faces the bottom surface 25 of the tub.

The groove 422 may include a first protrusion 424 protruding downward from the inner circumferential surface of the cap, and a second protrusion 426 protruding to correspond to the first protrusion in the outer circumferential surface of the cap. The first seal 420 can be disposed between the first protrusion 424 and the second protrusion 426 to restrict movement.

The first seal can seal the interface between the bottom surface 25 of tub and the cap or between the seat portion 25*b* and the cap, thereby restricting dirt from entering a gap between the cap and the bottom surface 25 of tub or the seat portion 25*b*, and further restricting the cap and the bottom surface 25 of the tub from colliding each other. The first seal can also attenuate vibration of the air jet generator, thereby restricting damages resulting from such vibration.

The cap according to an embodiment of the present disclosure will be described with reference to FIG. 8.

Figure 8:
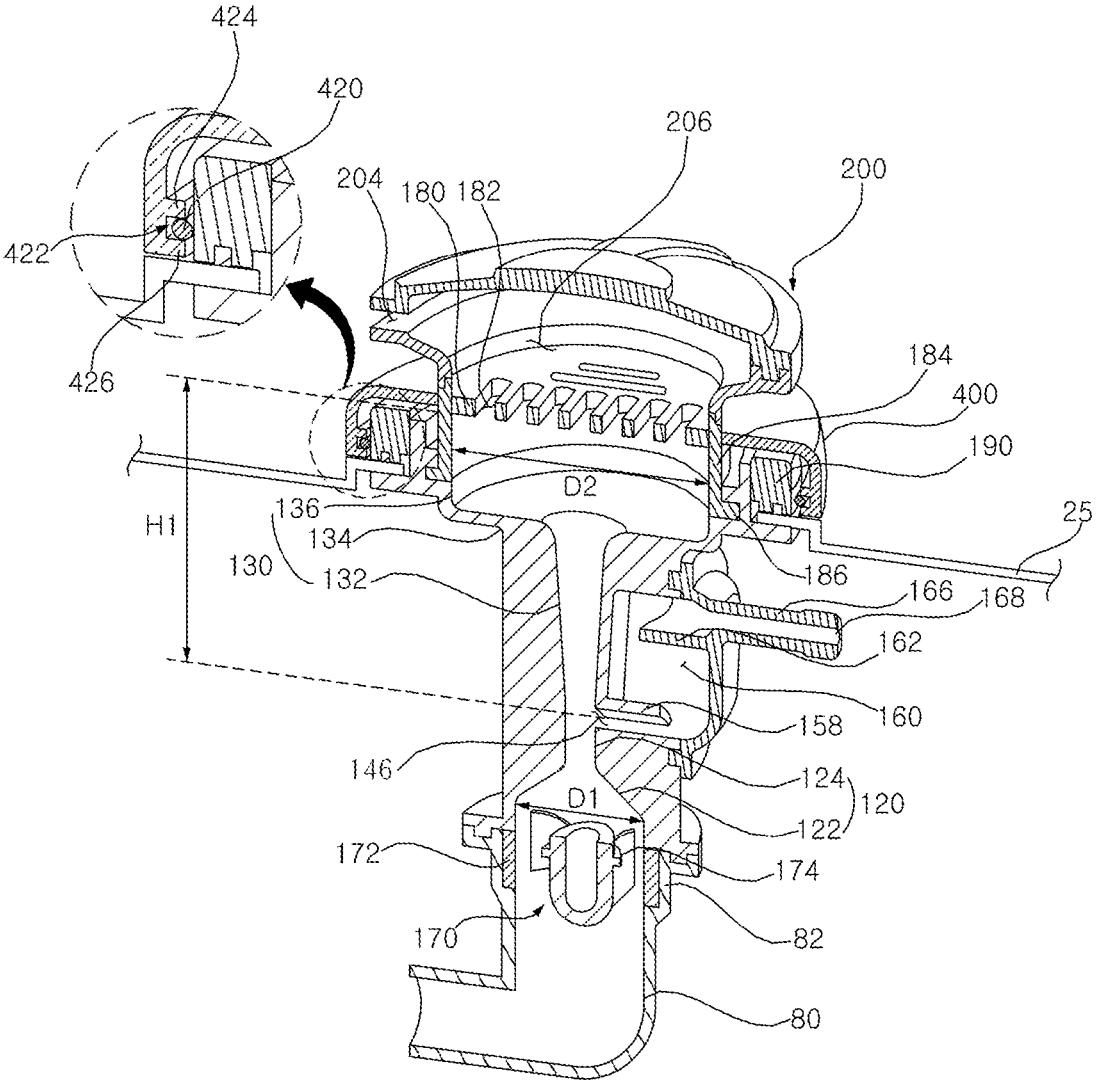
FIG. 8 is a cross-sectional view of another example air jet generator.

As shown in FIG. 8, a second seal 430 may be included inside the cap 400, and disposed between the fastening member 190 of the coupling portion and the cap 400. In some implementations, the second seal 430 may be disposed inside the bottom surface of the cap 400.

A groove 432 may be provided in the inner circumferential surface of the cap 400. At least a portion of the second seal 430 may be inserted into the groove 432. The groove 432 can be defined on the inner circumferential surface of the cap 400 that faces the fastening member 190.

The groove 432 may include a third protrusion 434 protruding from the inner circumferential surface of the cap 400, and a fourth protrusion 436 protruding from the bottom surface of the cap so as to correspond to the third protrusion 434. The fourth protrusion 436 is spaced from the third protrusion 434 at certain distance. The second seal 430 is disposed between the third protrusion 434 and the fourth protrusion 434 to restrict movement.

A third protruding member and a fourth protruding member can be disposed at both ends of the groove. One of the protruding members extends inward from the lower end of the cap. For example, the fourth protruding member can protrude inward from the lower end of the cap.

The second seal can seal the interface between the fastening member 190 and the cap 400, thereby restricting dirt from entering a gap between the fastening member 190 and the cap 400, and further restricting the cap 400 and the fastening member 190 from colliding each other. The second seal can attenuate vibration of the air jet generator, thereby restricting damages resulting from such vibration.

The other elements of the air jet generator and the dishwasher are configured identically or similarly to the those described above, and thus the description of such identical or similar elements is omitted but incorporated by reference to the extent it does not conflict with the other cap designs.

Figure 9:
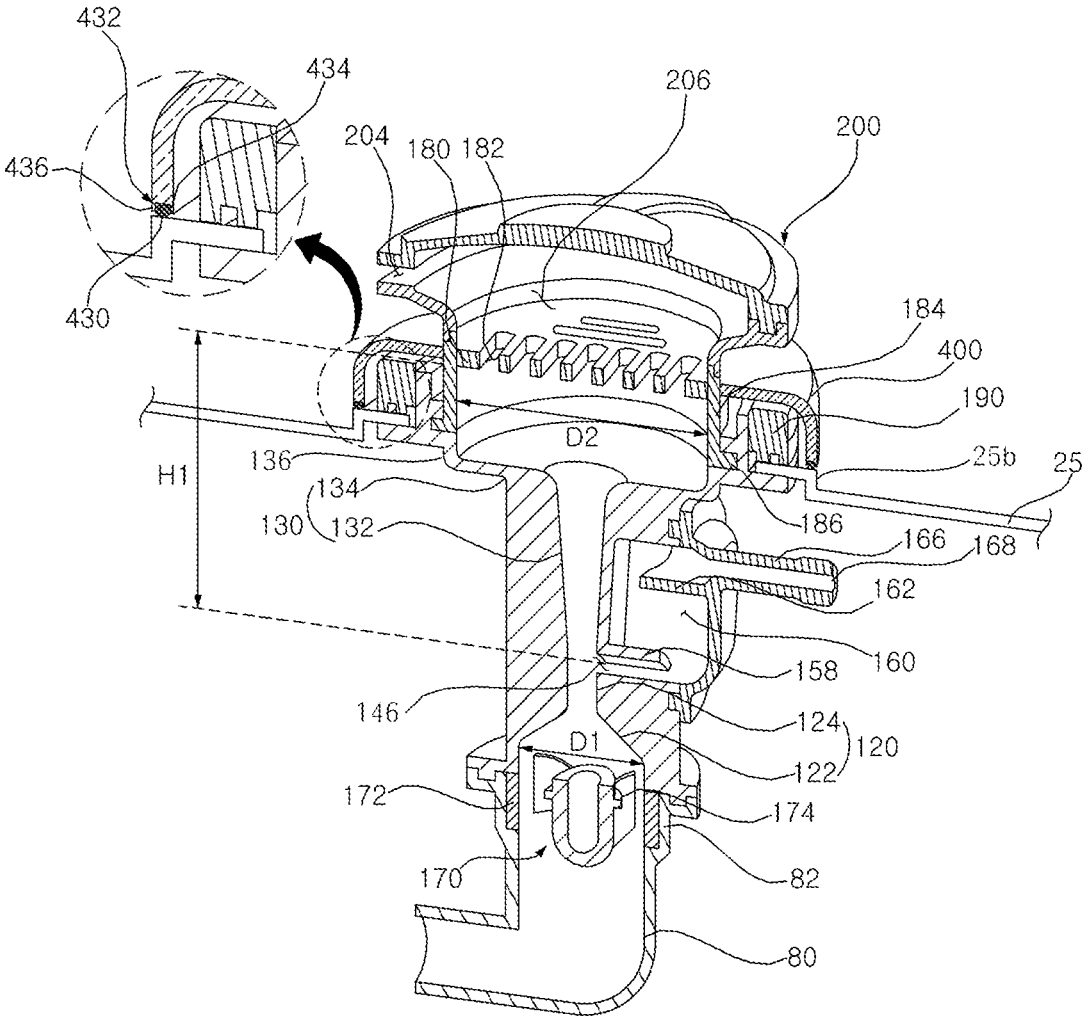
FIG. 9 is a cross-sectional view of yet another air jet generator.

The cap according to an embodiment of the present disclosure will be described with reference to FIG. 9.

In some implementations, the cap 400 is configured to be disposed in the air jet nozzle 200. The cap 400 may be formed integrally with the air jet nozzle 200, or may be formed separately and connected to the air jet nozzle 200. In some implementations, the cap 400 may be disposed relative to the air jet nozzle 200 such that the air jet nozzle 200 and the cap 400 define the discharge hole 204. For example, the cap 400 may provide a lower end of the discharge hole 204 while the air jet nozzle 200 provides an upper end of the discharge hole 204. The cap 400 may extend from the lower end of the discharge hole 204 of the air jet nozzle. For example, the cap 400 may be extended from the lower nozzle portion 208. Accordingly, the cap 400 can further cover the coupling portion of the air tap casing 184 and the nozzle 200, thereby further restricting dirt from being trapped.

The cap in this example includes only a downward extension portion without a horizontal protrusion, and thus can restrict dirt that would otherwise be trapped in the horizontal protrusion of the caps.

The description of the same or similar elements is omitted but incorporated by reference to the extent it does not conflict with the other cap designs.

The cap according to an embodiment of the present disclosure will be described with reference to FIG. 10.

In embodiments where the mounting hole 25*a* and the seat portion 25*b* are defined at the bottom surface 25 of the tub and the air jet generator passes through the mounting hole 25*a* and is coupled to the seat portion 25*b*, the distal end of the cap 400 that is protruded from the nozzle 200 may cover the outer surface of the seat portion 25*b* together with the coupling portion 300. Accordingly, the cap 400 can also cover the seat portion 25*b*, and thus can more effectively restrict the inflow of dirt and the leakage of washing water.

The description of the same or similar elements is omitted but incorporated by reference to the extent it does not conflict with the other cap designs.

An example operation of the cap 400 according to the present disclosure configured as described above is explained as follows.

The cap 400 can serve to restrict dirt from being stuck in the coupling portion with the air jet generator 100 or the bottom surface 25 of the tub. In some implementations, the cap 400 can be disposed in the air jet nozzle, the air tap, and/or the air tap casing. In some implementations, the cap 400 can cover the outer portion of the discharge port 140, covers the coupling portion 300, covers the fastening member 190, covers the seat portion 25*b* of the bottom of tub, and/or other suitable portions, to restrict contamination of the washing water.

The cap 400 can include a protrusion protruding in the radial direction and a downward extension portion 442 extended downward. The protrusion may be a horizontal protrusion 440 extended horizontally. The protrusion may include a bent portion 444. The shape of the cap 400 can serve to allow the dirt contained in the washing water to flow down without being collected or trapped.

The cap 400 may include a first seal 420 between the bottom surface of the cap and the bottom surface of the tub. Alternatively or in addition, the cap 400 may include a second seal 430 between the inner side of the distal end of the cap and a coupling ring (e.g., the fastening member). These seals in the cap can efficiently restrict the inflow of dirt, attenuate noise and vibration, and restrict water leakage.

In the dishwasher according to the present disclosure, a cap can cover the portion of the air jet generator exposed to the inside of the tub to restrict dirt from getting stuck in the exposed portion or between the exposed portion and the tub, thereby maintaining cleanliness inside the dishwasher, and restricting contamination of the circulating washing water.

In addition, the pollution prevention cap can include at least one layer of noise restriction wall against noise generated from the air crushing pipe, thereby reducing the outward generated noise and alleviating the impact against the bottom of the tub due to vibration to restrict damage.

In addition, since the cap covers the fastening portion between the air jet generator and the tub, the cap can restrict corrosion of the fastening portion, and further restrict washing water from leaking through the gap in the fastening portion.

In addition, the cap can be configured to protrude from the discharge port of the air jet generator or the outer surface of the air jet nozzle and extended downward such that the cap can be easily installed.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A dishwasher comprising:

a tub;

a washing nozzle disposed in the tub and configured to spray washing water;

a washing pump configured to pump the washing water to the washing nozzle;

a sump configured to receive the washing water; and an air jet generator mounted in the tub and configured to supply air to the washing water to generate an air bubble, the air jet generator including:

an air jet nozzle configured to spray the washing water that contains the air bubble into the tub;

a discharge port configured to discharge the washing water that contains the air bubble to the air jet nozzle; and a cap that surrounds at least a portion of the discharge port that is exposed in the tub, wherein the cap is configured to restrict dirt from being trapped in a portion of the air jet generator that is exposed into the tub.

2. The dishwasher of claim 1, further comprising a fastener that is coupled to the discharge port and fixes the air jet generator to the tub, wherein the cap surrounds the fastener.

3. The dishwasher of claim 2, wherein the discharge port includes a first thread on an outer circumferential surface of the discharge port, wherein the fastener includes a second thread on an inner circumferential surface of the fastener, the second thread engaging with the first thread of the discharge port.

4. The dishwasher of claim 3, further comprising a seal disposed between the cap and the fastener.

5. The dishwasher of claim 4, wherein the cap further comprises a groove at an inner circumferential surface of the cap that faces the fastener, and wherein at least a portion of the seal is inserted into the groove.

6. The dishwasher of claim 5, wherein the cap further comprises first and second protrusions extending toward the fastener and at least partially defining the groove, and wherein at least one of the first or second protrusions extends from an end of the cap that interfaces with the tub.

7. The dishwasher of claim 2, wherein the cap includes a first portion that is spaced from the fastener, and extended in a radial direction relative to the discharge port.

8. The dishwasher of claim 2, wherein the cap includes a second portion that is radially spaced apart from an outer circumferential surface of the fastener.

9. The dishwasher of claim 1, wherein the cap is disposed at least partially in the air jet nozzle.

10. The dishwasher of claim 9, wherein the cap is disposed relative to the air jet nozzle to define a discharge hole of the air jet nozzle, and wherein the cap extends in a direction away from the air jet nozzle.

11. The dishwasher of claim 1, wherein the air jet generator comprises:

an air tap disposed in the air jet nozzle and configured to break the air bubble contained in the washing water; and an air tap casing disposed between the air jet nozzle and the discharge port and having inner and outer surfaces, the air tap casing supporting the air tap at the inner surface of the air tap casing, wherein the cap is disposed on the outer surface of the air tap casing.

12. The dishwasher of claim 1, wherein the tub further comprises:

a mounting hole defined at a surface of the tub and configured to at least partially receive the air jet generator; and a seat portion around the mounting hole and extending from the surface of the tub toward an interior of the tub, wherein the cap surrounds at least a portion of the seat portion.

13. The dishwasher of claim 1, wherein the cap comprises:

a first portion extending radially; and a second portion extending from a circumferential end of the first portion in a direction away from the air jet nozzle.

14. The dishwasher of claim 13, wherein the second portion includes a third portion that is rounded at the circumferential end of the first portion.

15. The dishwasher of claim 1, further comprising a seal disposed at an interface between the cap and the tub.

16. The dishwasher of claim 15, wherein the cap further comprises a groove at an end of the cap that faces the tub, and wherein the seal is at least partially inserted into the groove.

17. The dishwasher of claim 1, wherein the cap includes a body extending in a direction away from the air jet nozzle.

18. The dishwasher of claim 17, wherein the cap has at least one bent portion.

19. The dishwasher of claim 1, wherein the air jet nozzle includes a discharge hole, and wherein the cap is disposed between the discharge hole of the air jet nozzle and the discharge port.

20. The dishwasher of claim 1, wherein the tub comprises a seat portion at least partially extending from a surface of the tub toward an interior of the tub, and wherein the cap is disposed on the seat portion.

* * * * *